US005564963A

United States Patent [19]

Chan

[11] Patent Number: 5,564,963

[45] Date of Patent: Oct. 15, 1996

[54] AIR-CUSHIONED TOY

[76] Inventor: Albert W. T. Chan, 10 Millstone Court, Unionville, Ontario, Canada

[21] Appl. No.: 114,934

[22] Filed: Sep. 2, 1993

[51] Int. Cl.[6] ..... A63H 33/40

[52] U.S. Cl. ..... 446/179; 180/116

[58] Field of Search ..... 446/176, 178, 446/179, 211, 36, 37, 48, 56, 57; 180/116, 124; 414/676

[56] References Cited

U.S. PATENT DOCUMENTS

| | | | |
|---|---|---|---|
| 3,229,410 | 1/1966 | Bross | 46/1 |
| 3,233,693 | 2/1966 | Havercamp | 180/116 |
| 3,375,893 | 4/1968 | Mackie | 414/676 |
| 3,416,626 | 12/1968 | Nagamatsu | 180/124 |
| 3,488,882 | 1/1970 | Scott | 46/74 |
| 3,561,558 | 2/1971 | Parkhouse | 180/116 |
| 3,691,670 | 9/1972 | Lemelson | 46/1 |
| 4,249,334 | 2/1981 | Goldfarb et al. | 46/1 |
| 4,272,856 | 6/1981 | Wegener et al. | 180/116 |
| 4,643,268 | 2/1987 | Jones et al. | 414/676 |
| 4,686,719 | 8/1987 | Johnson et al. | 414/676 |
| 4,815,926 | 3/1989 | Chaffee et al. | 414/676 |
| 4,964,835 | 10/1990 | Suto | 446/154 |

OTHER PUBLICATIONS

"Making A Model Air Sled," Popular Science, May 1960, pp. 156–158 by Harry Walton.

See attached excerpt of brochure of H.K. Toys (Jan. 1992; Jun. 1992; Dec. 1992 p. 43, p. 337).

*Primary Examiner*—Robert A. Hafer

*Assistant Examiner*—Jeffrey D. Carlson

*Attorney, Agent, or Firm*—Brian W. Gray; John C. Hunt

[57] ABSTRACT

This invention relates to a toy supported by a self-generated air-cushion. The toy has a platform, a pillow, a fan and a motor to drive the fan. The platform sits above the pillow. The fan and its motor are located centrally and substantially within the pillow and close to the surface over which the toy hovers. The fan draws air into the pillow and expels air through perforations in a bottom sheet of the pillow. This generates an air-cushion between the pillow and a surface over which the toy hovers. The air-cushion enables the toy to glide along the surface upon application of an external force, such as a push from a child's hand. The platform supports a figure which can be a real or animated character.

19 Claims, 4 Drawing Sheets

AIR-CUSHIONED TOY

FIELD OF THE INVENTION

This invention relates to a my supported by a self-generated air cushion.

BACKGROUND OF THE INVENTION

Air-cushioned toys are popular with children because they glide easily along a flat surface with little effort on the child's part. An air-cushioned toy does not rest on a surface; rather it hovers on an air-cushion between the surface and the bottom of the toy. The surface can be a solid flat surface, such as a tabletop, or a liquid surface, such as water.

Most air-cushioned toys have a fan mounted within the body of the toy. An electric or battery-powered motor drives the fan. The fan draws air into an opening at the top of the toy and ejects air from an opening in the bottom of the toy. Ejecting the air forms an air cushion between the bottom of the toy and the surface. Such a mechanism appears in U.S. Pat. No. 3,691,670 (Lemelson), U.S. Pat. No. 3,488,882 (Scott) and U.S. Pat. No. 3,229,410 (Bross).

A number of air-cushioned toys also have a skirt around their periphery which assists in forming an air chamber beneath the toy.

In U.S. Pat. No. 4,964,835 (Suto), the toy has a body with a top and a bottom. There are perforations in the top and the bottom of the body. A skirt attaches to the periphery of the bottom of the body. The skirt is made of plastic of a material which reduces frictional resistance with the ground. The skirt is expandable and contractible as a bag and can be perforated with holes.

In Suto's invention, the fan and its motor are located within the body of the toy, not within the skirt. The primary use of the skirt is to buoy the toy in water, to create an air-cushion chamber beneath the toy and to distance the fan and its motor within the toy from the water. In one embodiment, the frictional resistance between the skirt and the water is reduced by air passing from the perforations in the bottom of the body, into a chamber beneath the toy and then through a narrow gap between the bottom of the skirt and the surface (see page 7, lines 10–15 of this patent). In another embodiment, the frictional resistance is reduced by air passing through perforations in the skin onto the surface. Another air-cushioned toy which uses a skirt is the toy described in U.S. Pat. No. 4,249,334 (Goldfarb et al.). This patent describes a toy hovercraft and its launcher. The hovercraft's frame has an outwardly flaring skirt with a peripheral lip to assist in forming an air chamber beneath the toy. The motor is located centrally within the toy and rotates a fan which draws in air through inlets in the toy and expels the air from the bottom of the toy creating a pressurized air cushion in a chamber beneath the toy.

All of the air-cushioned toys described in the previously cited U.S. patents and the toys currently on the market locate the fan and motor within the toy. However, it is not always practical, safe or visually pleasing to have the fan and its motor located within the toy.

The air-cushion mechanisms on the market are not efficient in supporting toys. These mechanisms are all located within the toy away from the surface on which the toy is to ride. It is inefficient to locate the mechanism for the air-cushion within the toy and distant from the surface. It is better to locate the mechanism close to the air cushion, namely, beneath the toy adjacent to the surface over which the toy glides.

Thus, a need exists for an air-cushion mechanism which is located beneath the toy, but which can still intake and expel sufficient air to form an air cushion.

SUMMARY OF THE INVENTION

Thus the invention comprises a toy supported on a self-generated air cushion for movement over a surface, comprising: a base for the toy, a pillow located beneath the base and adjacent to the surface, the pillow having a top and a bottom perforated sheet, the sheets being joined together, and means for drawing air into the pillow and expelling air from the pillow through perforations in the bottom sheet, and onto the surface, the means being located centrally and substantially within the pillow and attached to the base for the toy.

The air-cushion mechanism is located beneath the base of the toy, adjacent to the surface over which the toy glides, does not tend to tip the toy, can intake and expel sufficient air to support itself and a toy, and its sound may not detract from the enjoyment of the toy.

The mechanism can support a relatively heavy toy on a self-generated air cushion for movement of the toy over a surface. The toy includes a base, the base having a bottom and a top surface; a pillow located beneath the base, adjacent to the surface, and having a top and a bottom perforated sheet, the sheets being joined together; and means for drawing air into the pillow and expelling air from the pillow through perforations in the bottom sheet and onto the surface, the means for drawing and expelling air being located within the pillow, and being attached to the bottom surface of the base for the toy, and adjacent to the surface over which the toy moves.

The means for drawing and expelling air is preferably a fan or other air-generating unit and the means to drive the fan is preferably a battery-powered or electrically powered motor. The motor is operably connected to the fan to provide power to the fan.

BRIEF DESCRIPTION OF THE DRAWINGS

In the accompanying drawings.

DETAILED DESCRIPTION OF A PREFERRED EMBODIMENT

Figure 1:
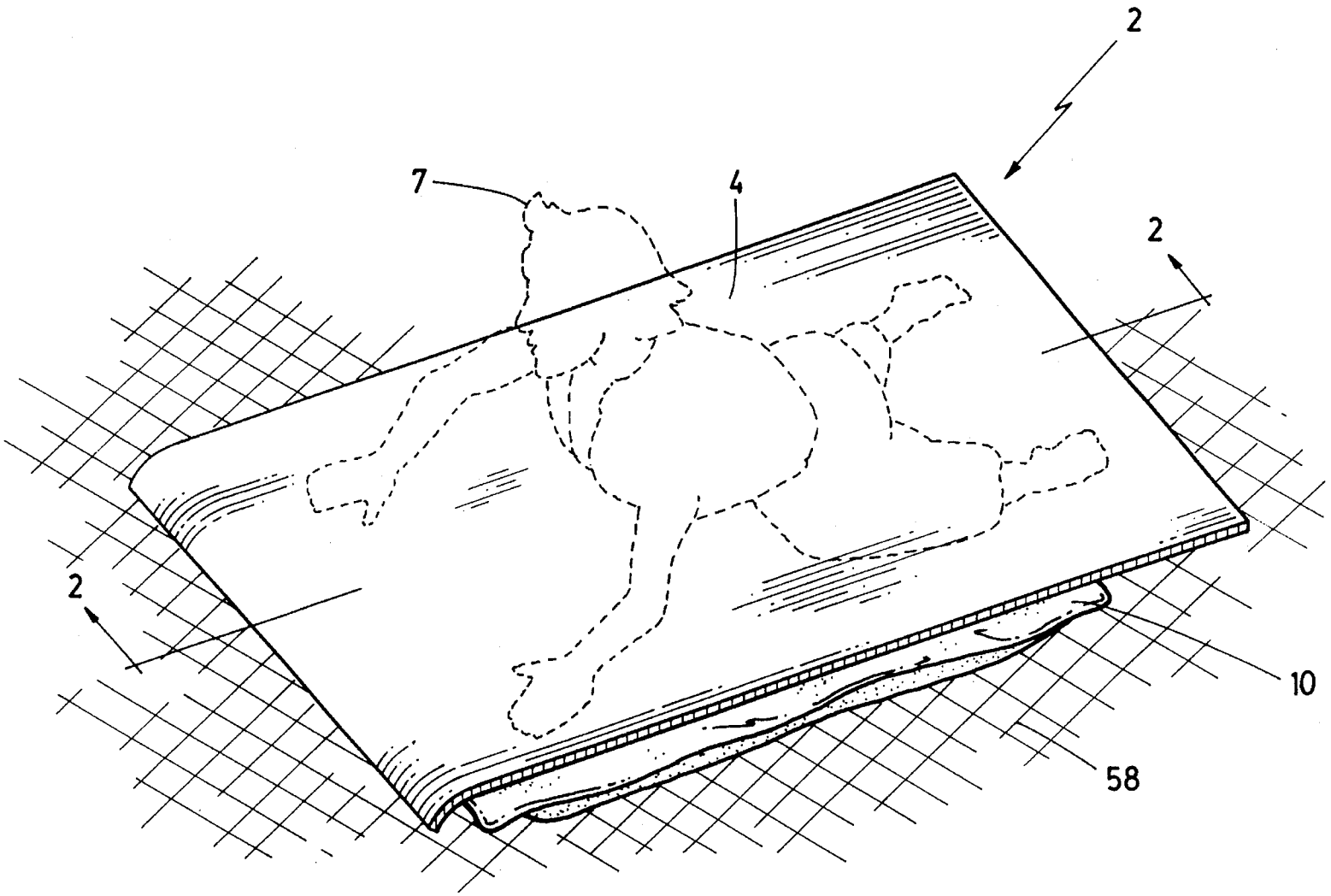
FIG. 1 is a perspective view of an air-cushion toy of the present invention showing a toy figure in stippled lines.

In one embodiment, the fan 20 and its motor 22 are enclosed in a housing 30 which has a roof 50, side walls 48 and a floor 46. The roof 50 includes a cover 21 for the fan 20 and the cover 21 has an aperture (not shown) adjacent to the apex of the fan 20. The housing 30 is located within the pillow 10, is securely and removably attached to the bottom surface 8 of the base 4 for the toy 2 and is located centrally of the base for the toy. Enclosing the fan and the motor within the housing helps to reduce the noise of the powerful motor required to create an efficient air-cushion for a toy. Securely attaching the housing to the platform reduces vibration between the housing and the platform, again reducing noise.

In one embodiment, the fan 20 draws air into the pillow through an aperture 5.

In another embodiment, the upper sheet 12 of the pillow 10 is attached to the periphery of the roof 50 of the housing 30 and the lower sheet 14 is attached to the periphery of the floor 46 of the housing 30. Thus, the pillow 10, the fan 20 and the motor 22 are located beneath the base 4 and the toy 2 is supported on an air-cushion generated between the pillow 10 and the surface 58.

The motor 22 for the fan 20 has a switch 56 and the floor 46 of the housing 30 has an opening 54 to allow a user to access the switch 56 to switch the motor 22 on and off. When the motor 22 is turned on, the toy 2 remains generally at one location until a force external to the toy 2, such as a push of a child's hand, is applied to the toy 2. The toy 2 then moves in the direction of the force.

In one embodiment, the base 4 is a platform on which a FIG. 7 is mounted either permanently or removably. The base 4 could resemble a flying carpet and the figure mounted on the flying carpet could be a real or animated character. Alternatively, the base 4 could resemble a pizza and the figure mounted on the pizza could be a cartoon character associated with pizzas. These are some examples of the appearance of the toy.

FIGS. 1 to 4 show by way of example a preferred embodiment of an air-cushion toy of the present invention.

Figure 2:
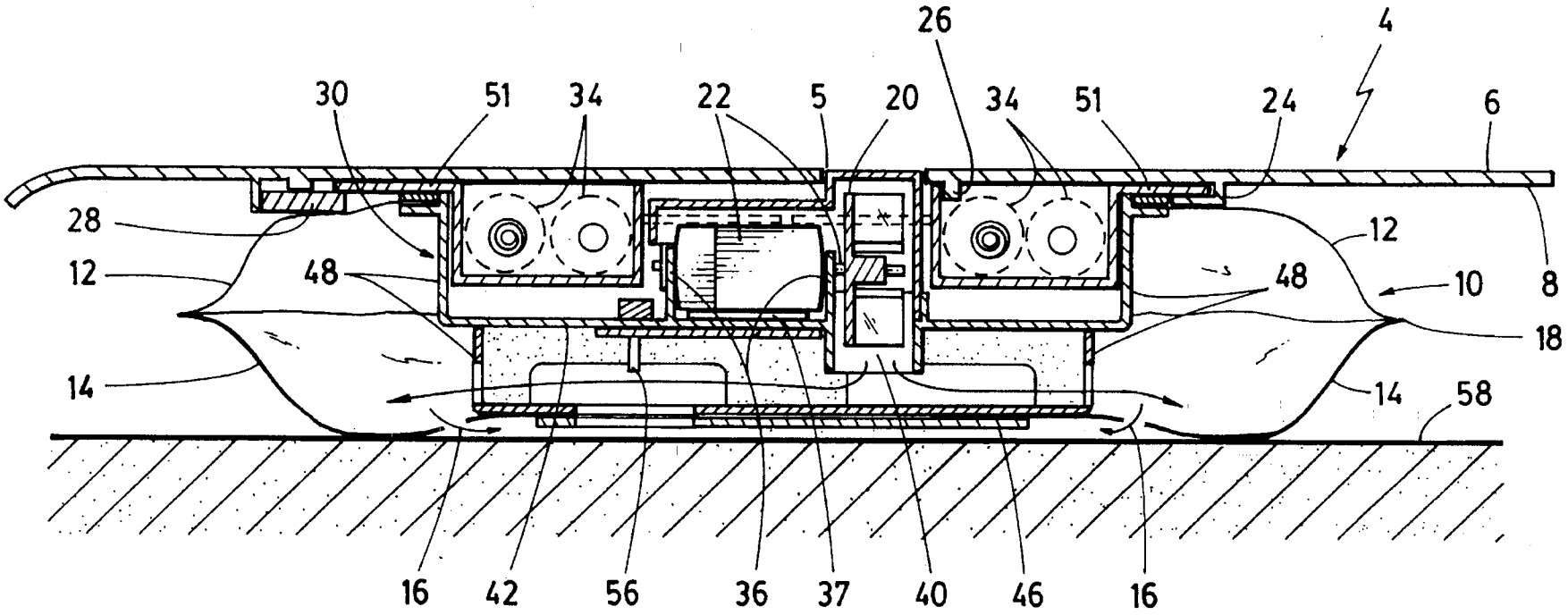
FIG. 2 is a longitudinal sectional view of the air-cushion toy without the toy figure along line 2—2 of FIG. 1.

Referring to FIGS. 1–2, the air-cushion toy 2 of this invention is composed of a platform 4, a pillow 10, a fan 20 and its motor 22.

As shown in FIG. 2, the platform 4 has an upper surface 6 and a lower surface 8. The platform 4 is made of plastic and, in one embodiment, is rectangular, but could be any shape. On the platform's lower surface 8 is a stop 24, abutment means 26, and a lock 28 which serve to keep a housing 30 for the fan 20 and motor 22 locked to the lower surface 8 of the platform 4.

Figure 3:
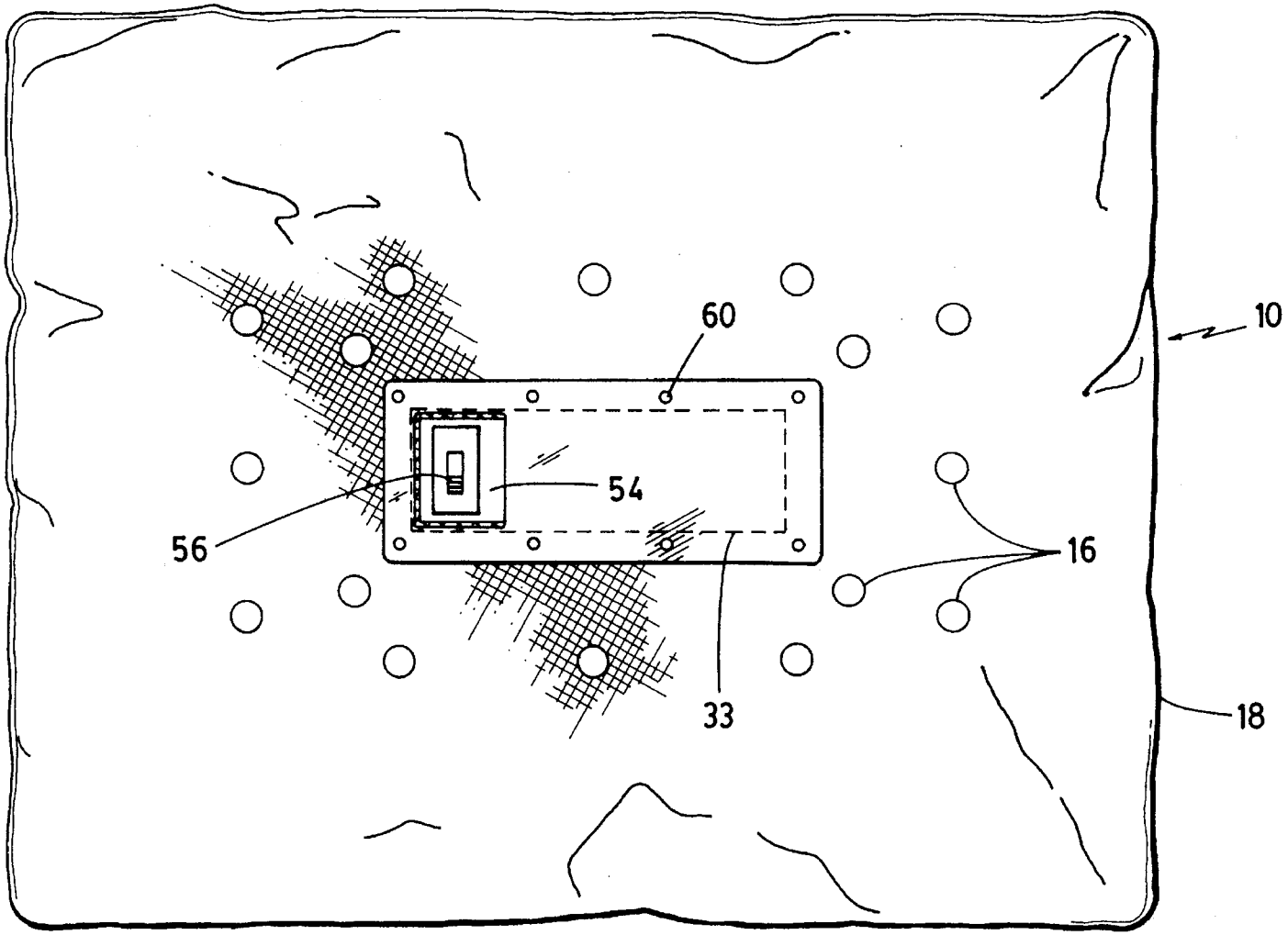
FIG. 3 is a bottom view of the pillow of the air-cushion toy.
Figure 4:
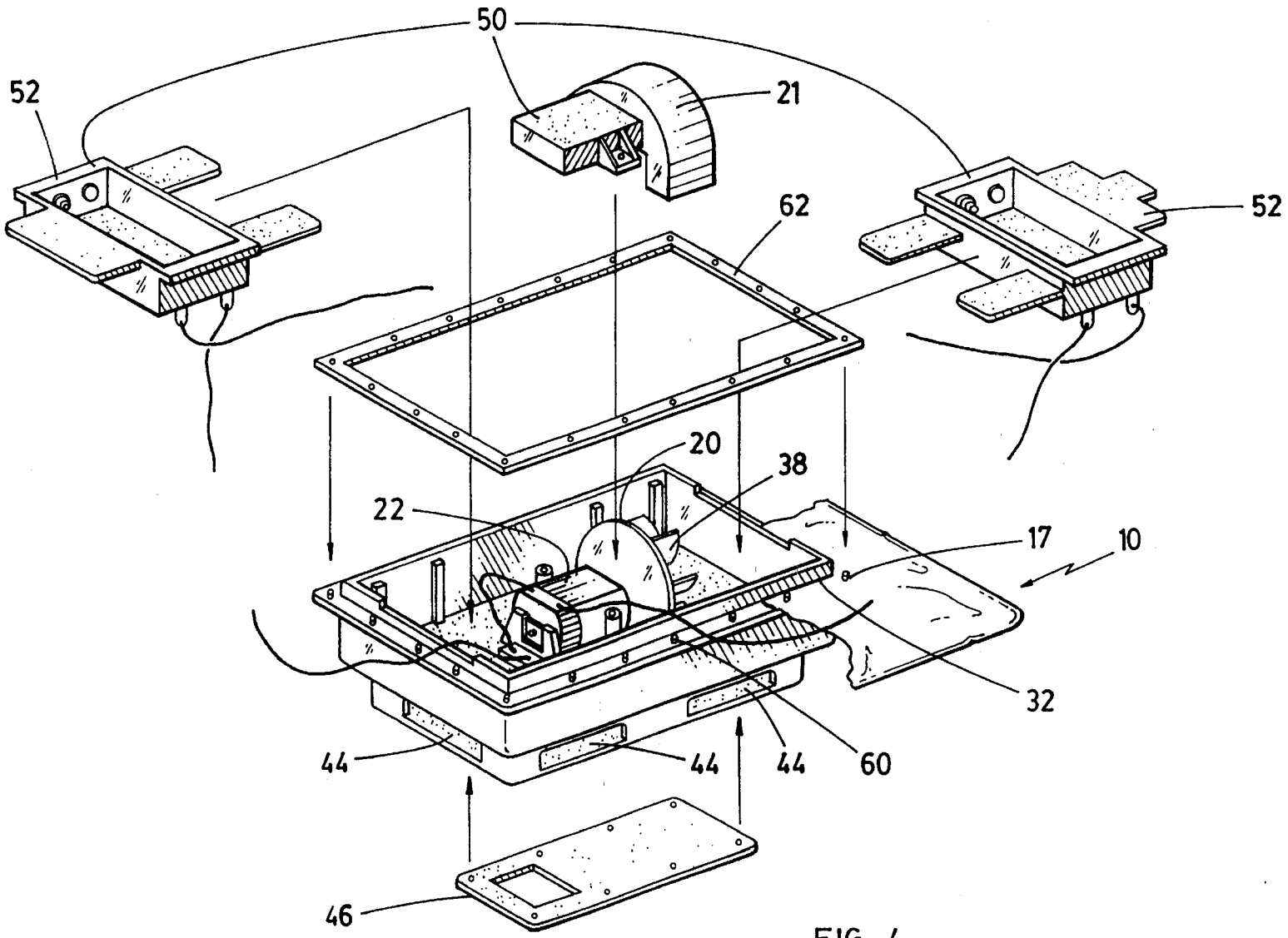
FIG. 4 is an exploded view of the air-cushion toy with the base and most of the pillow removed to illustrate the interior of the housing and pillow.

As shown in FIGS. 2 and 4, the fan 20 and its motor 22 are located substantially within the housing 30. The motor 22 uses a carbon conductor which reduces heat caused by frictional resistance. An example of a suitable motor is motor number FC-130S (2270), manufactured by Mabuchi Corporation. The motor 22 has a switch 56 (see FIG. 3) to turn the motor 22 on and off. The motor 22 is mounted on brackets 36 within the housing 30 and is further supported by pads 37 located between the motor 22 and the sub-floor 42 of the housing 30. The motor 22 is wired to and is powered by a series of four batteries 34 (see FIG. 4). The batteries are AA size alkaline batteries which are connected to the switch 56.

Locating the fan 20 and motor 22 within the pillow 10 and beneath the platform. 4 makes it easier to form an air-cushion between the pillow 10 and the surface 58 than if the fan and motor were located within the toy or above the platform. When the fan 20 is closer to the surface 58, it is able to apply a more direct force of air onto the surface 58 thus creating an air cushion which is able to support a toy efficiently. If the fan 20 and motor 22 were located within the toy, they would be unable to create a strong air cushion, or if they did create it, the motor would soon burn out or would be too loud to enable a child to enjoy the toy.

It is important that the fan 20 and the motor 22 be located centrally of the platform 4 so that the platform 4 does not tip causing the toy 2 to be imbalanced.

The fan 20 is formed of plastic material such as ABS material and is fixed to a rotary drive shaft of the motor 22. The wings 38 of the fan 20 pass through a rectangular opening 40 in the sub-floor 42. As shown in FIG. 4, there are outlets 44 for air in the floor 46 of the housing 30.

The housing 30 is made of durable plastic such as ABS material. The housing 30 consists of a sub-floor 42, a floor 46, walls 48 and a roof 50. As shown in FIG. 4, the roof 50 includes as a cover 21 for the fan 20 and the battery-powered motor 22. This top of the roof 50 juts into the aperture 5 in platform 4 and is flush with it forming a level surface. As shown in FIG. 4, the roof 50 also includes compartments 52 for the batteries 34. As shown in FIG. 3, the floor 46 contains an opening 54 to allow a user to access a switch 56 to the motor 22 from outside the toy 2. The sub-floor 42 includes an opening 40 to allow the air from the fan 20 to pass through the opening 40, through outlets 44 in the side walls 48, into the pillow 10 and through perforations 16.

Arms 51 on the compartments 52 for batteries 34 are used to lock the housing 30 to the platform 4. Securely locking the housing 30 to the platform 4 and enclosing the motor 22 and fan 20 within the housing 30 helps to reduce the noise of the motor 22 and fan 20.

As shown in FIG. 2, the pillow 10 has an upper sheet 12 and a lower sheet 14. The sheets of the pillow 10 join together at their edges 18. The dimensions of the pillow 10 are 7 inches by 8.5 inches.

As shown in FIG. 3, there are perforations 16 in the lower sheet 14. The perforations 16 are positioned inwards from the edges 18 of the pillow 10 and form a generally rectangular pattern. As shown in FIG. 3, there is a perforation 33 in the lower sheet 14 through which the floor 46 of the housing 30 juts. Surrounding the perforation 33 is a series of perforations 17 (not shown). Pegs 60 on the floor 46 of the housing 30 poke through perforations 17 in the lower sheet. The floor 46 secures the lower sheet 14 to the pegs 60.

Moving to FIG. 4, there is one large perforation 32 in the upper sheet 12 through which the roof 50 of the housing 30 juts to attach to the lower surface 8 of the platform. Surrounding the large perforation in the upper sheet is a series of perforations 17 as shown in FIG. 4. Pegs 60 on the housing 30 poke through perforations 17 in the upper sheet. A rectangular frame 62 secures the upper sheet 12 to the pegs 60.

The sheets 12, 14 are made of plastic, soft rubber or vinyl so as to reduce frictional resistance with the surface 58. The sheets must be made of a material which is sufficiently thick so that the sheets 12, 14 do not rip but which is sufficiently thin-so that air can quickly inflate the pillow 10. An example of a suitable material is PVC material.

As shown in FIG. 1, on the platform's upper surface 6 is a FIG. 7 which could be a real or animated character.

To operate the toy 2, one turns the switch 56 to the "on" position, the battery-powered motor 22 begins to rotate the fan 20, the fan draws air from the housing 30, from between cracks between the housing 30, the platform 4, and from aperture 5. The fan expels air through the outlet 40 in the sub-floor 42, and through the outlets 44 in the side walls 48, the air passes into the pillow 10, inflates the pillow and then passes through perforations 16 in the lower sheet 14 of the pillow 10. An air cushion is generated between the surface 58 and the lower sheet 14 of the pillow 10. The air-cushion lifts the floor 46 of the housing 30 above the surface 58 over which the toy 2 moves. One moves the toy 2 by applying an external force to any part of the toy 2.

Although the preferred embodiment of this invention has been described in detail with reference to the accompanying drawings, this invention is not limited to this embodiment. Changes may be made by one skilled in the art without departing from the spirit or scope of the invention as defined in the claims.

We claim:

1. A toy supported on a self-generated air cushion for movement over a surface, comprising:

a base for the toy;

a pillow located beneath the base and adapted to be placed adjacent to the surface, the pillow having a top sheet and a bottom perforated sheet, which are joined; and a fan driven by a battery-powered motor for drawing air into the pillow and expelling air from the pillow through perforations in the bottom sheet, and onto the surface, the fan being located centrally and substantially within the pillow and attached to the base for the toy; and wherein, there is a housing for the fan and motor, the housing having a roof, side walls and a floor, and wherein the housing is removably attached to the base for the toy.

2. A toy as set out in claim 1, wherein air is drawn into the pillow through the housing.

3. A toy as set out in claim 1, wherein the pillow is plastic.

4. A toy as set out in claim 1, wherein the housing is located centrally of the base for the toy.

5. A toy as set out in claim 1, wherein the top sheet of the pillow is attached to the periphery of the roof of the housing.

6. A toy as set out in claim 1, wherein the bottom sheet is attached to the periphery of the floor of the housing.

7. A toy as set out in claim 1, wherein the top sheet and the bottom sheet have edges which are joined.

8. A toy as set out in claim 1, further comprising a switch for the motor and wherein the floor of the housing allows access to the switch to switch the motor on and off.

9. A toy as set out in claim 1, wherein the toy remains generally at one location until a force external to the toy is applied to the toy.

10. A toy as set out in claim 1, wherein the base of the toy has an aperture and the roof includes a cover which fits into the aperture.

11. A toy as set out in claim 1, wherein the base is a platform and there is a figure removably mounted on the platform.

12. A toy as set out in claim 1, wherein the base is a platform and there is a figure permanently mounted on the platform.

13. A toy supported on a self-generated air cushion for movement over a surface, comprising:

a platform having a bottom surface and a top surface, a plastic pillow located beneath the platform, and adjacent to the surface, and having a top and a bottom perforated sheet, which are joined, a battery-powered fan for drawing air into the pillow and expelling air frown the pillow through perforations in the bottom sheet, the battery-powered fan being located centrally and substantially within the pillow and having a switch, and a housing for the battery-powered fan, the housing being located centrally of the platform and having a roof, side walls and a floor, and wherein the top sheet of the pillow is attached to the roof and the bottom sheet is attached to the floor and wherein the housing is removably attached to the bottom surface of the platform, wherein the floor allows access to the switch to switch the motor on and off.

14. A toy as set out in claim 13, wherein the top sheet and the bottom sheet have edges which are joined.

15. A toy as set out in claim 13, wherein the toy remains generally at one location until a force external to the toy is applied to the toy.

16. A toy as set out in claim 13, wherein the platform has an aperture and the roof fits into the aperture.

17. A toy as set out in claim 13, further comprising a figure mounted on the top surface of the platform.

18. A toy as set out in claim 17, wherein the figure is permanently mounted.

19. A toy as set out in claim 17, wherein the figure is removably mounted.

* * * * *